US005779347A

United States Patent [19]

Seok

[11] Patent Number: 5,779,347

[45] Date of Patent: Jul. 14, 1998

[54] APPARATUS AND METHOD FOR CONTROLLING LIGHTING OF FLUORESCENT LAMP FOR REFRIGERATOR

[75] Inventor: Jin Oh Seok, Kyungki-Do, Rep. of Korea

[73] Assignee: Samsung Electronics Co., Ltd., Suwon, Rep. of Korea

[21] Appl. No.: 812,164

[22] Filed: Mar. 6, 1997

[30] Foreign Application Priority Data

May 23, 1996 [KR] Rep. of Korea ..... 96-17836

[51] Int. Cl.[6] ..... F21V 33/00

[52] U.S. Cl. ..... 362/94; 362/92; 362/212

[58] Field of Search ..... 362/92, 94, 211, 362/212, 126, 100; 200/61.62; 315/84

[56] References Cited

U.S. PATENT DOCUMENTS

| | | | |
|---|---|---|---|
| 2,953,909 | 9/1960 | Sharpe . | |
| 2,979,637 | 4/1961 | Welna | 315/84 |
| 3,028,208 | 4/1962 | Sharpe . | |
| 3,751,653 | 8/1973 | Henry | 240/6 |
| 4,404,619 | 9/1983 | Ferguson | 362/222 |
| 5,388,418 | 2/1995 | Martin et al. | 362/94 X |
| 5,508,898 | 4/1996 | McGovern | 362/92 |
| 5,676,459 | 10/1997 | Bedford et al. | 362/390 |

*Primary Examiner*—Ira S. Lazarus
*Assistant Examiner*—Nhat-Hang H. Lam
*Attorney, Agent, or Firm*—Burns, Doane, Swecker & Mathis, L.L.P.

[57] ABSTRACT

A fluorescent lamp light-up control apparatus for use in a refrigerator having a plurality of fluorescent lamps which are installed in a plurality of cooling compartments, for illuminating a corresponding cooling compartment is provided, which includes a preheating starter which is commonly connected to the plurality of fluorescent lamps, a switch for selectively connecting the starter to one of the plurality of fluorescent lamps, and a light-up controller for controlling the switching means so that the starter is connected to the fluorescent lamp in an opened cooling compartment when a door of one of the plurality of cooling compartments is opened, thereby performing a preheating operation necessary for lighting up each fluorescent lamp installed in a fresh food compartment and a freezing compartment by using a single starter, which provides an economic product.

4 Claims, 4 Drawing Sheets

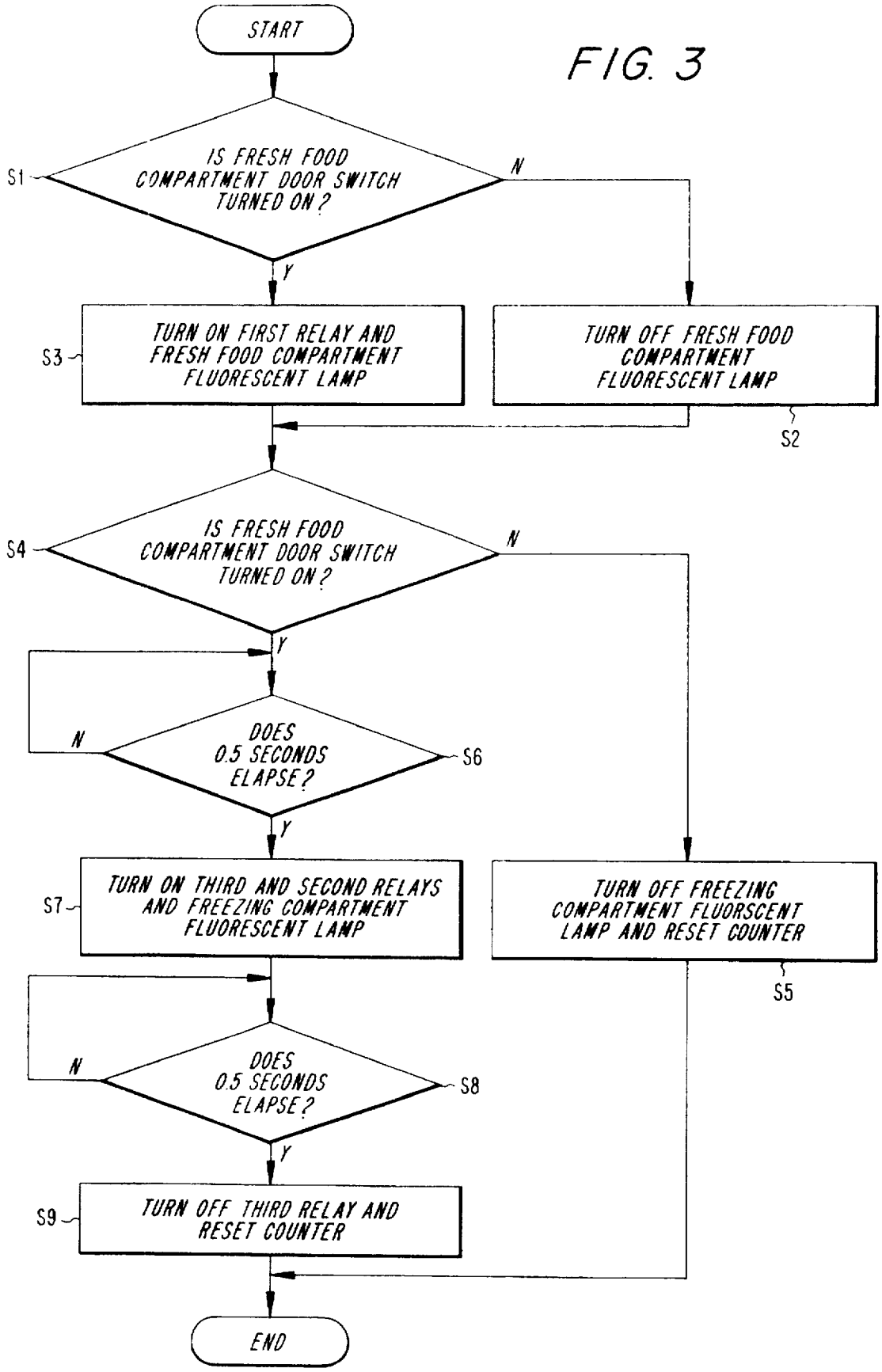
START
FIG. 3
S1
IS FRESH FOOD COMPARTMENT DOOR SWITCH TURNED ON?
N
Y
S3
TURN ON FIRST RELAY AND FRESH FOOD COMPARTMENT FLUORESCENT LAMP
TURN OFF FRESH FOOD COMPARTMENT FLUORESCENT LAMP
S2
S4
IS FRESH FOOD COMPARTMENT DOOR SWITCH TURNED ON?
N
Y
N
DOES 0.5 SECONDS ELAPSE?
S6
Y
S7
TURN ON THIRD AND SECOND RELAYS AND FREEZING COMPARTMENT FLUORESCENT LAMP
TURN OFF FREEZING COMPARTMENT FLUORSCENT LAMP AND RESET COUNTER
S5
N
DOES 0.5 SECONDS ELAPSE?
S8
Y
S9
TURN OFF THIRD RELAY AND RESET COUNTER
END

APPARATUS AND METHOD FOR CONTROLLING LIGHTING OF FLUORESCENT LAMP FOR REFRIGERATOR

BACKGROUND OF THE INVENTION

The present invention relates to an apparatus for controlling the lighting of a fluorescent lamp for use in a refrigerator and a method therefor, and more particularly, to a fluorescent lamp lighting control apparatus and method for controlling the lighting each fluorescent lamp installed in a fresh food compartment and a freezing compartment of a refrigerator using a single starter.

Lamps which are lit according to opening of a refrigerator door are typically installed in a refrigerator. The lamps used in the refrigerator are chiefly incandescent lamps. The reason why an incandescent lamp is used in the refrigerator is due to a faster lighting time than that of a fluorescent lamp. A pre-heating time of approximately one second is generally necessary for lighting a fluorescent lamp. Since a flickering phenomenon occurs in the fluorescent lamp until it is illuminated, fluorescent lamps are used in places where frequent light-up operations are not performed. Hence, it is generally known that it is not preferable to employ a fluorescent lamp in a refrigerator which is frequently opened and closed.

There has been a recent trend toward the use a large-sized refrigerators in which fluorescent lamps are used. Fluorescent lamps have a higher power consumption efficiency in the order of one-third through a quarter times that of incandescent lamps. Also, the fluorescent lamps have the advantage of providing a comfortable light, a small amount of radiation heat and a lifetime of five to ten times that of one incandescent lamp. Therefore, it is appropriate to employ a fluorescent lamp in a large-sized refrigerator.

First, a light-up procedure of a typical fluorescent lamp will be described with reference to FIG. 4 which shows a schematic circuit diagram of a prior art fluorescent lamp light-up circuit. There are a variety of components necessary for lighting a fluorescent lamp 60. Here, a light-up circuit using a starter 55 will be described. Filaments 57 and 58 exist in both inner ends of the fluorescent lamp 60. These filaments 57 and 58 are connected to respective ends of the starter 55. Also, the two filaments 57 and 58 are connected to a circuit composed of a stabilizer 53 and an alternating-current (AC) power source 51 both of which are connected in series. As a result, a closed circuit (hereinafter called a preheating closed circuit) is formed by a cycle of the AC power source 51, the stabilizer 53, the left-hand filament 57, the starter 55, and the right-hand filament 58.

When a supply of power from the AC power source 51 starts, power is supplied along the preheating closed circuit to preheat the filaments 57 and 58. Upon the completion of the pre-heating step, a current flow toward the starter 55 is instantly stopped, to thereby generate a high-voltage counter-electromotive force in the stabilizer 53 and light up the fluorescent lamp 60. After lighting up the fluorescent lamp 60, another closed circuit (hereinafter called a light-up closed circuit) is formed by a cycle of the AC power source 51, the stabilizer 53, the left-hand filament 57, and the right-hand filament 58, to maintain the lit state of the fluorescent lamp 60.

As described above, it is essential to perform a preheating procedure of the fluorescent lamp when lighting up the fluorescent lamp in a refrigerator, in which a starter is used for preheating. Since fluorescent lamps are installed in a fresh food compartment and a freezing compartment, respectively, each lamp requires a starter. Since a starter operates only for a very, short time, it is economical if a single starter can be used to preheat both fluorescent lamps.

SUMMARY OF THE INVENTION

To solve the above problems, it is an object of the present invention to provide a fluorescent lamp light-up control apparatus for a refrigerator that is capable of performing a preheating operation of each fluorescent lamp installed in a fresh food compartment and a freezing compartment of the refrigerator, using a single starter.

It is another object of the present invention to provide a fluorescent lamp light-up control method for a refrigerator capable of performing a preheating operation of each fluorescent lamp installed in a fresh food compartment and a freezing compartment of the refrigerator, using a single starter.

To accomplish the above object of the present invention, there is provided a fluorescent lamp light-up control apparatus for use in a refrigerator having a plurality of fluorescent lamps which are installed in a plurality of cooling compartments, for illuminating a corresponding cooling compartment, the fluorescent lamp light-up control apparatus comprising: a preheating starter which is commonly connected to the plurality of fluorescent lamps; a switching means for selectively connecting the starter to one of the plurality of fluorescent lamps; and a light-up controller for controlling the switching means so that the starter is connected to the fluorescent lamp in an opened cooling compartment when a door of one of the plurality of cooling compartments is opened.

Here, it is preferable that the light-up controller controls the switching means in such a manner that when doors of the plurality of cooling compartments are nearly simultaneously opened, the starter is connected to the fluorescent tamp of the opened cooling compartment whose door is opened earlier than the other doors, and connected to the fluorescent lamp of the opened cooling compartment whose door is opened later than the other opened doors after a predetermined time necessary, for preheating elapses, to thereby perform a sequential light-up operation.

There is also provided a fluorescent lamp light-up control method for use in a refrigerator having a plurality of fluorescent lamps which are installed in a plurality of cooling compartments, for illuminating a corresponding cooling compartment, the fluorescent lamp light-up control method comprising the steps of: providing a preheating starter which is selectively connected to the fluorescent lamp of each the cooling compartment; sensing whether a door of the each cooling compartment is opened; and connecting the starter to the fluorescent lamp of an opened cooling compartment according to the sensed result.

BRIEF DESCRIPTION OF THE DRAWINGS

FIG. 3 is a flow-chart diagram for explaining a fluorescent lamp light-up control method according to the present invention.

DETAILED DESCRIPTION OF THE PREFERRED EMBODIMENTS

An embodiment of the present invention will be described with reference to the drawings.

Figure 1:
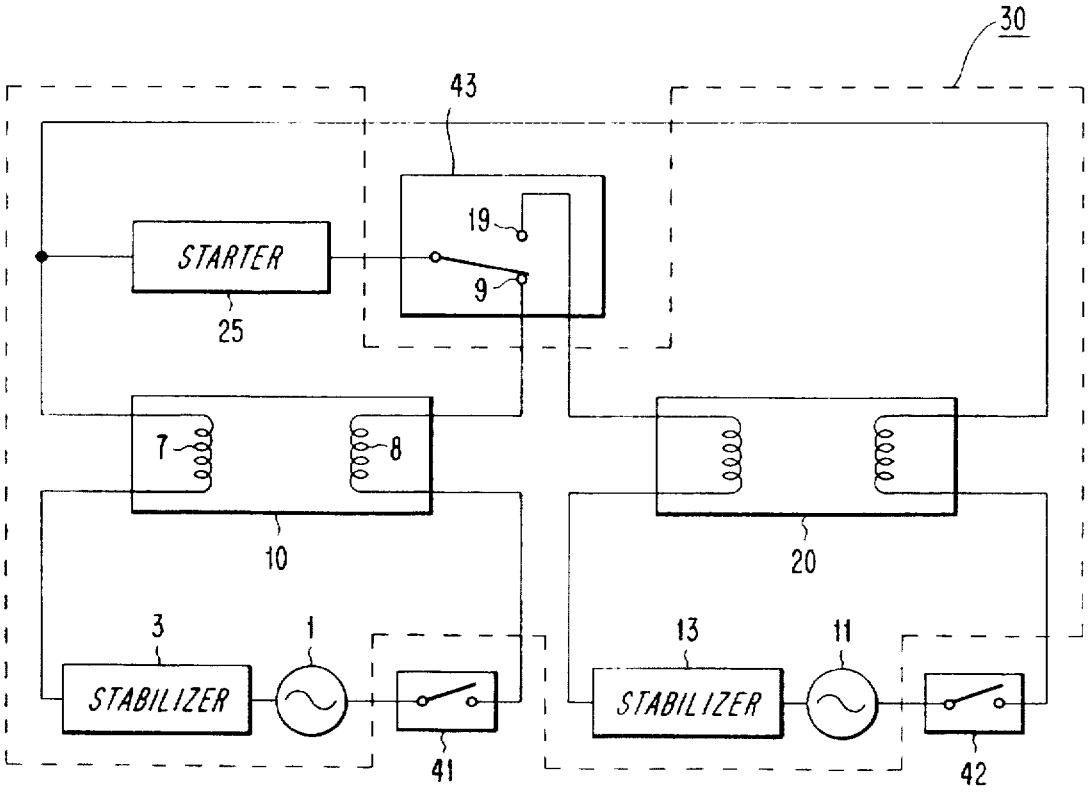
FIG. 1 is a circuit diagram of a fluorescent lamp light-up circuit according to the present invention.

Referring to FIG. 1, a fresh food compartment fluorescent lamp 10 is installed in a fresh food compartment, and a freezing compartment fluorescent lamp 20 is installed in a freezing compartment of a refrigerator. The fluorescent lamp 10 is connected to a power source 1 and a stabilizer 3 which are connected to series, and the fluorescent lamp 20 is connected to a power source 11 and a stabilizer 13 which are connected to series. Each power source 1 and 11 is controlled by a first switch 41 and a second switch 42, respectively. A starter 25 for preheating fluorescent lamps 10 and 20 is commonly connected to both fluorescent lamps 10 and 20. The starter 25 is controlled by a third switch 43. A moving contact of the third switch 43 is selectively connected to a first port 9 and a second port 19, to selectively connect one of fluorescent lamps 10 and 20 to the starter 25. Here, reference numeral 30 denotes a fluorescent lamp light-up circuit similar to the conventional fluorescent lamp light-up circuit, which excludes the switches 41, 42 and 43 from the FIG. 1 circuit.

If the first switch 41 is turned on at a state where the third switch 43 is connected to the first port 9, a preheating closed circuit constituted by the AC power source 1, the stabilizer 3, the left-hand filament 7, the starter 25, and the right-hand filament 8 whereby the AC power source 1 preheats both the filaments 7 and 8. Then, the current flow toward the starter 25 is interrupted to enable the stabilizer 3 to generate a high-voltage counter-electromotive force to thereby light up the fluorescent lamp 10. After lighting up the fluorescent lamp 10, a light-up closed circuit constituted by the AC power source 1, the stabilizer 3, the left[29a]hand filament 7, and the right-hand filament 8 is formed, to maintain the light-up state of the fresh food compartment fluorescent lamp 10 until power is interrupted by opening the first switch 41. If the second switch 42 is turned on at a state where the third switch 43 is connected to the second port 19, the freezing compartment fluorescent lamp 20 is lit in accordance with the procedure used for lighting the fresh food compartment fluorescent lamp 10.

Figure 2:
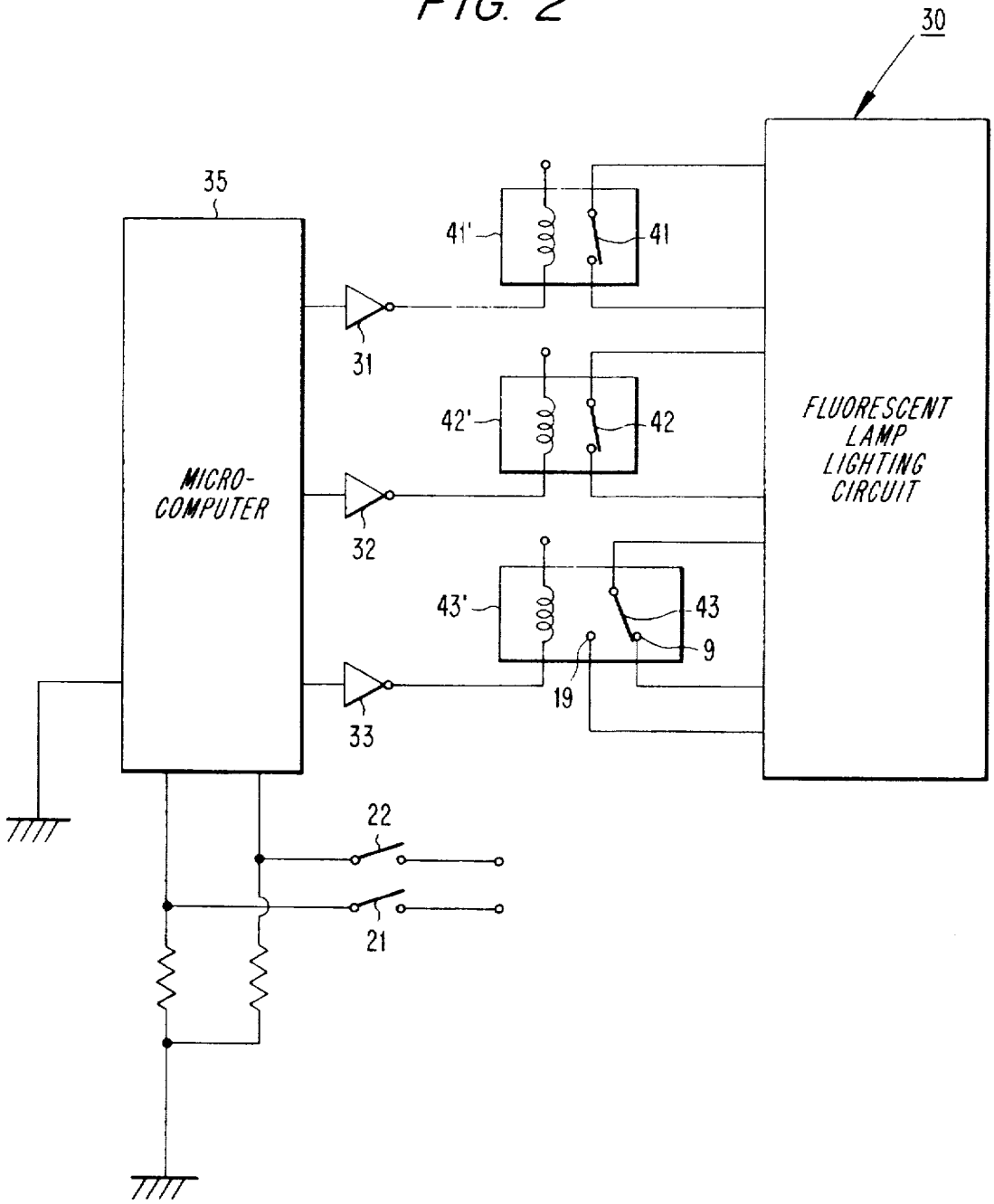
FIG. 2 is a circuit diagram of a control circuit of a switching apparatus which controls the FIG. 1 circuit.
Figure 4:
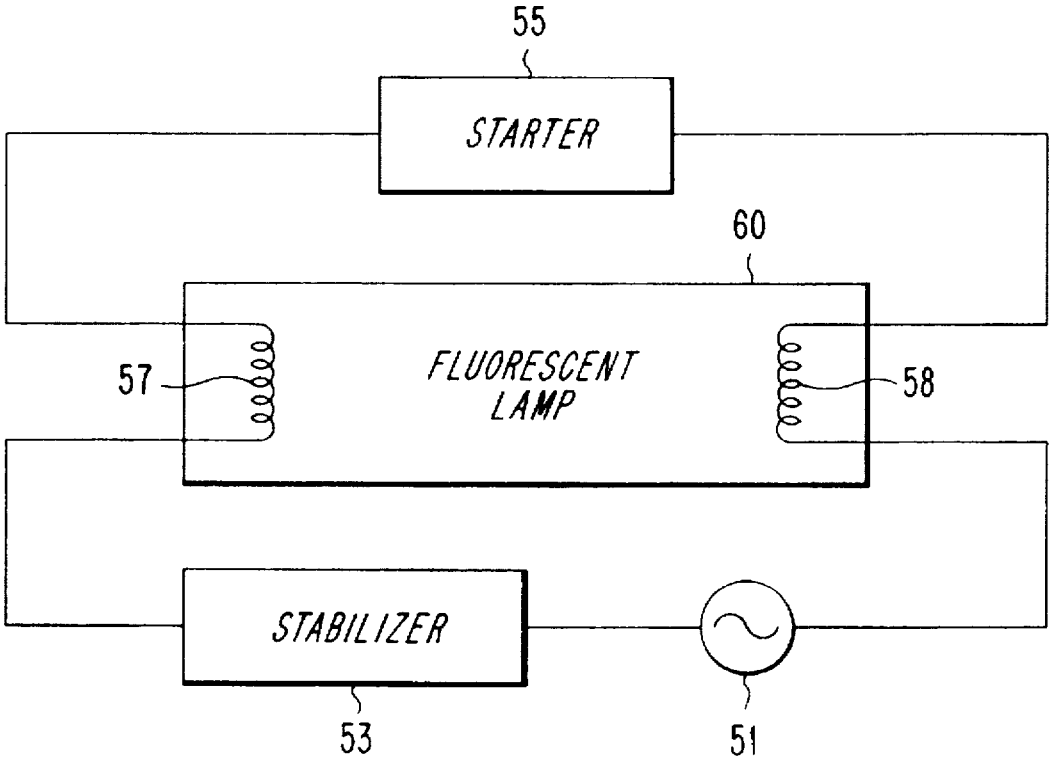
FIG. 4 (PRIOR ART)
FIG. 4 is a schematic circuit diagram of a prior art fluorescent lamp light-up circuit.

FIG. 2 is a circuit diagram of a control circuit of a switching apparatus which controls the FIG. 1 circuit. The switching apparatus is controlled by a microcomputer 35. A fresh food compartment door switch 21 and a freezing compartment door switch 22 are connected to two input ports of the microcomputer 35, respectively. Three output ports of the microcomputer 35 are connected to first through third buffers 31, 32 and 33, respectively. The output port of the first buffer 31 is connected to a first relay 41' which drives the first switch 41, the output port of the second buffer 32 is connected to a second relay 42' which drives the second switch 42, and the output port of the third buffer 33 is connected to a third relay 43' which drives the third switch 43. The moving contact of the third switch 43 is connected to the first port 9 at a normal state. If the third switch 43 is activated by the third buffer 33, the moving contact of the third switch 43 is connected to the second port 19. The respective buffers 31, 32 and 33 play a role of converting an output voltage level of the microcomputer 35 into a voltage level for driving the respective relays 41', 42' and 43'.

Once the fresh food compartment door is opened, the fresh food compartment door switch 21 is turned on. The microcomputer 35 senses whether the fresh food compartment door switch 21 is turned on. If the microcomputer 35 senses the fresh food compartment door is opened, the microcomputer 35 outputs a signal to the first buffer 31 to drive the first relay 41'. Accordingly, the fresh food compartment fluorescent lamp 10 is lighted. If the freezing compartment door is opened, the freezing compartment door switch 22 is turned on. The microcomputer 35 senses whether the freezing compartment door switch 22 is turned on. If the microcomputer 35 senses the freezing compartment door is opened, the microcomputer 35 outputs a signal firstly to the third buffer 33 to drive the third relay 43' and to connect the starter 25 to the freezing compartment fluorescent lamp 20, and then outputs a signal to the second buffer 32 to drive the second relay 42'. Accordingly, the freezing compartment fluorescent lamp 20 is lighted.

When the fresh food compartment door and the freezing compartment door are nearly simultaneously opened, the fluorescent lamp corresponding to the door which is opened earlier than the other door is first lighted and then after a time elapse of approximately 0.5 seconds necessary for preheating the fluorescent lamp by the starter 25, the fluorescent lamp corresponding to the door which is opened later is lighted, under the control of the microcomputer 35. Here, the light-up operation of each fluorescent lamp 10 and 20 are the same as the above-described procedure. Accordingly, both the fluorescent lamps 10 and 20 can be lighted using only a single starter 25.

FIG. 3 is a flow-chart diagram for explaining a fluorescent lamp light-up control method according to the present invention. The microcomputer 35 judges whether or not the fresh food compartment door switch 21 is turned on (step Si). When the fresh food compartment door switch 21 is turned off, the fresh food compartment fluorescent lamp 10 is maintained in an off-state (step S2) and when the former is turned on, the latter is turned on by driving the first relay 41' (step S3).

Thereafter, the microcomputer 35 judges whether or not the freezing compartment door switch 22 is turned on (step S4). When the freezing compartment door switch 22 is turned off, the fresh food compartment fluorescent lamp 20 is maintained in an off-state and a counter is reset (step S5). When the freezing compartment door switch 22 is turned on, the counter in the microcomputer 35 operates to count a time for 0.5 seconds (step S6). If the counter counts 0.5 seconds, the microcomputer 35 recognizes that a preheating operation for lighting up the fresh food compartment fluorescent lamp 10 which has first started a light-up operation is completed. Then, the third relay 43' is driven to connect the starter 25 to the freezing compartment fluorescent lamp 20 and then the second relay 42' is driven to turn on the freezing compartment fluorescent lamp 20 (step S7). Then, if 0.5 seconds elapses again (step S8), the microcomputer 35 recognizes that a preheating operation for lighting up the freezing compartment fluorescent lamp 20 is completed. Then, the third relay 43' is turned off and the counter is reset (step S9) to complete the lighting operation.

The above-described procedure has been described only with respect to the case where the fresh food compartment door switch 21 is first turned on. If the freezing compartment door switch 22 is first turned on, the above-described procedure is performed first with respect to the freezing compartment fluorescent lamp 20.

As described above, the fluorescent lamp light-up control apparatus and method according to the present invention can perform a preheating operation necessary for lighting up each fluorescent lamp installed in a fresh food compartment and a freezing compartment by using a single starter, which provides an economic benefit.

What is claimed is:

1. A fluorescent lamp light-up control apparatus for use in a refrigerator having a plurality of fluorescent lamps which are installed in a plurality of cooling compartments to illuminate a corresponding cooling compartment, the fluorescent lamp light-up control apparatus comprising:

a preheating starter which is commonly connected to said plurality of fluorescent lamps;

a switching means for selectively connecting said preheating starter to one of said plurality of fluorescent lamps; and a light-up controller for controlling said switching means so that said preheating starter is connected to the fluorescent lamp in an opened cooling compartment when a door of one of said plurality of cooling compartments is opened.

2. The fluorescent lamp light-up control apparatus according to claim 1, wherein said light-up controller controls said switching means in such a manner that when at least two of said doors of said plurality of cooling compartments are nearly simultaneously opened said preheating starter is connected to the fluorescent lamp of the opened cooling compartment whose door is opened earlier than the other door, and connected to the fluorescent lamp of the opened cooling compartment whose door is opened later after a predetermined time necessary for preheating elapses, to thereby perform a sequential light-up operation.

3. A fluorescent lamp light-up control method for use in a refrigerator having a plurality of fluorescent lamps which are installed in a plurality of cooling compartments to illuminate a corresponding cooling compartment, the fluorescent lamp light-up control method comprising the steps of:

providing a preheating starter which is selectively connected to the fluorescent lamp of each said cooling compartments;

sensing whether a door of said each cooling compartment is opened; and connecting said preheating starter to a fluorescent lamp of an opened cooling compartment according to said sensed result.

4. The fluorescent lamp light-up control method according to claim 3, further comprising the steps of connecting said preheating starter to the fluorescent lamp of the opened cooling compartment whose door is opened first, and connecting the preheating starter to the fluorescent lamp of an opened cooling compartment whose door is opened later than the first opened door after a predetermined time necessary for preheating elapses, in the event that at least two doors of the said plurality of cooling compartments are nearly simultaneously opened.

* * * * *